US008342059B2

(12) United States Patent
Hu

(10) Patent No.: US 8,342,059 B2
(45) Date of Patent: Jan. 1, 2013

(54) DUSTPROOF SEAL FOR RATCHET WRENCH

(76) Inventor: Bobby Hu, Taichung (TW)

( * ) Notice: Subject to any disclaimer, the term of this patent is extended or adjusted under 35 U.S.C. 154(b) by 513 days.

(21) Appl. No.: 12/713,501

(22) Filed: Feb. 26, 2010

(65) Prior Publication Data

US 2010/0236363 A1 Sep. 23, 2010

(30) Foreign Application Priority Data

Mar. 17, 2009 (TW) ..... 98108613 A

(51) Int. Cl.
*B25B 13/46* (2006.01)

(52) U.S. Cl. ..... 81/60; 81/63.1

(58) Field of Classification Search ..... 81/60–63, 81/63.1, 63.2; 277/345, 353, 377, 402, 403
See application file for complete search history.

(56) References Cited

U.S. PATENT DOCUMENTS 4,934,220 A * 6/1990 Slusar et al. ..... 81/63.2
5,495,783 A * 3/1996 Slusar et al. ..... 81/63.2
5,921,158 A 7/1999 Slusar et al. ..... 81/63
8,109,180 B2 * 2/2012 Hu ..... 81/60

* cited by examiner

*Primary Examiner* — David B Thomas
(74) *Attorney, Agent, or Firm* — Alan Kamrath; Kamrath IP Lawfirm, P.A.

(57) ABSTRACT

A ratchet wrench includes a head having a compartment rotatably receiving a drive member. Two gaps are defined between the head and the drive member. The drive member includes a dust groove intermediate the gaps along an axis. The dust groove includes first and second faces spaced along the axis and a third face extending between the first and second faces. A dustproof seal is compressed and received in the dust groove to block communication between the gaps. The seal includes a ring having first and second surfaces spaced along the axis. An outer periphery of the seal presses against a peripheral wall of the compartment. A wing extends from one of the first and second surfaces of the ring, presses against one of the first and second faces of the dust groove, and is not in contact with the third face of the dust groove.

17 Claims, 14 Drawing Sheets

DUSTPROOF SEAL FOR RATCHET WRENCH

BACKGROUND OF THE INVENTION

The present invention relates to a dustproof seal for a ratchet wrench and, more particularly, to a dustproof seal for preventing dust, debris, or the like from entering the ratchet wrench while allowing smooth operation of the ratchet wrench.

A type of ratchet wrench includes a head and a handle interconnected to the head. The head includes a bore having an inner surface with a plurality of teeth. A drive member is rotatably received in the bore. A pawl is received in the drive member and includes teeth for engagement with the teeth of the head. A reversing lever is mounted to a side of the head and fixed by a screw to the drive member. To allow smooth rotation of the drive member, a gap is provided between the inner surface of the bore and an outer periphery of the drive member. Dust may enter an area between the teeth of the bore and the teeth of the pawl via the gap, resulting in non-smooth operation of the ratchet wrench as well as unreliable engagement between the teeth of the drive member and the bore and, thus, leading to damage to the teeth of the drive member and the bore and/or insufficient torque. To avoid these problems, a seal having first and second lips is provided between an annular recess in the head and an annular flange of the drive member. The first lip engages an end surface of the annular recess, and the second lip engages an end face of the annular flange. An example of such a ratchet wrench is disclosed in U.S. Pat. No. 5,921,158. However, the dustproof effect is unsatisfactory, because the second lip can not prevent the dust that has passed the second lip from entering the gap. Furthermore, the size of the head must be increased to form the annular recess so as to receive the seal and not to adversely affect the structural strength of the head, leading an undesired increase in the overall weight of the ratchet wrench.

Thus, a need exists for a novel dustproof seal capable of preventing dust from entering the ratchet wrench while allowing smooth operation of the ratchet wrench and without increasing the size of the ratchet wrench.

BRIEF SUMMARY OF THE INVENTION

The present invention solves this need and other problems in the field of sealing of ratchet wrenches, by providing, in a preferred form, a ratchet wrench including a head and a handle interconnected to the head. The head includes first and second sides spaced along an axis. The head further includes a compartment having a peripheral wall and extending from the first side through the second side of the head. The head further includes a pawl groove defined in the peripheral wall of the compartment. A drive member includes an engaging portion rotatably received in the compartment about the axis. The drive member further includes a driving portion adapted to drive an object. The engaging portion of the drive member includes an outer periphery having a plurality of teeth. The outer periphery of the engaging portion of the drive member further includes a dust groove. The dust groove includes first and second faces spaced along the axis. The second face has a spacing to the first side of the head along the axis larger than the first face. The dust groove further includes a third face extending between the first and second faces. First and second gaps are defined between the head and the engaging portion of the drive member. The dust groove is intermediate the first and second gaps along the axis and in communication with the plurality of teeth of the drive member via the second gap. A pawl is slideably received in the pawl groove and includes a plurality of teeth for engagement with the plurality of teeth of the drive member. A dustproof seal made of an elastic material includes a ring and a wing extending from the ring. The ring includes first and second surfaces spaced along the axis. The ring further includes outer and inner peripheries spaced in a radial direction perpendicular to the axis and extending between the first and second surfaces. A diameter of the outer periphery of the ring in a natural state in the radial direction is larger than a diameter of the peripheral wall of the compartment in the radial direction. The wing extends from one of the first and second surfaces of the ring. A height of the wing in a natural state measured from the other of the first and second surfaces of the ring along the axis is larger than a height of the ring between the first and second surfaces of the ring and larger than a spacing between the first and second faces of the dust groove along the axis. The dustproof seal is compressed and received in the dust groove, with the outer periphery of the ring pressing against the peripheral wall of the compartment, with the wing pressing against one of the first and second faces of the dust groove, with the other of the first and second surfaces of the ring pressing against the other one of the first and second faces of the dust groove, and with the inner periphery of the ring and the wing not in contact with the third face of the dust groove. Communication between the first and second gaps is, thus, blocked by the seal.

In preferred forms, the dustproof seal further includes an inclined face formed between and at an obtuse angle to the outer periphery and the first surfaces of the ring. The first and second faces of the dust groove are parallel to each other and extend perpendicularly to the axis, and the third face of the dust groove extends perpendicularly to the first and second faces of the dust groove.

In a preferred form, the wing includes a first wing face extending from and at a first acute angle to the first surface of the ring. The wing further includes a second wing face extending from and at a second acute angle to the inner periphery of the ring. The first and second wing faces meet at an edge. The inner periphery of the ring is intermediate the outer periphery of the ring and the edge of the wing in the radial direction. The edge of the wing is intermediate the inner periphery of the ring and the third face of the dust groove in the radial direction. The edge presses against the second face of the dust groove.

In another preferred form, the wing includes a first wing face extending from and at a first acute angle to the second surface of the ring. The wing further includes a second wing face extending from and at a second acute angle to the inner periphery of the ring. The first and second wing faces meet at an edge. The inner periphery of the ring is intermediate the outer periphery of the ring and the edge of the wing in the radial direction. The edge of the wing is intermediate the inner periphery of the ring and the third face of the dust groove in the radial direction. The edge presses against the first surface of the dust groove.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
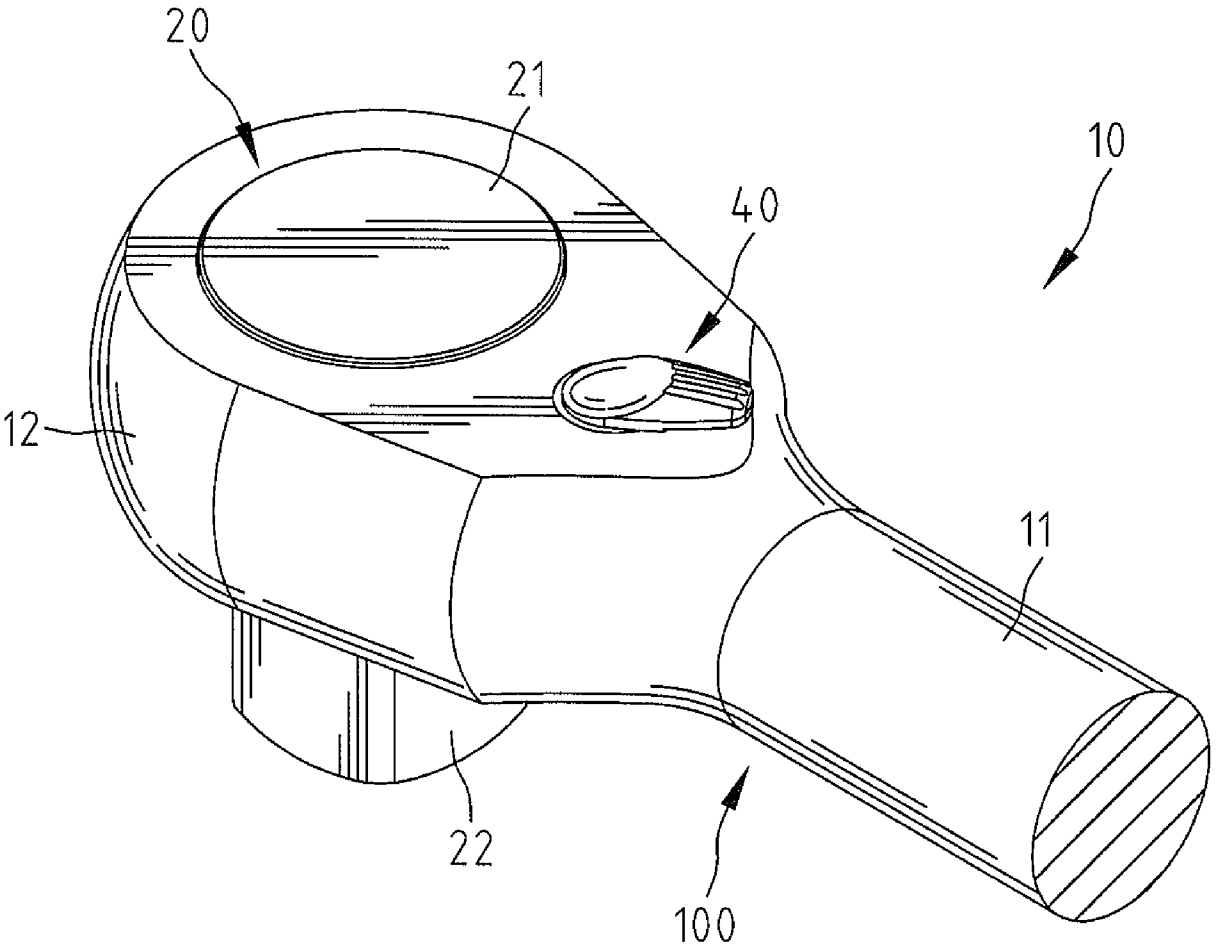
FIG. 1 shows a partial, perspective view of a ratchet wrench of a first embodiment according to the preferred teachings of the present invention.
Figure 2:
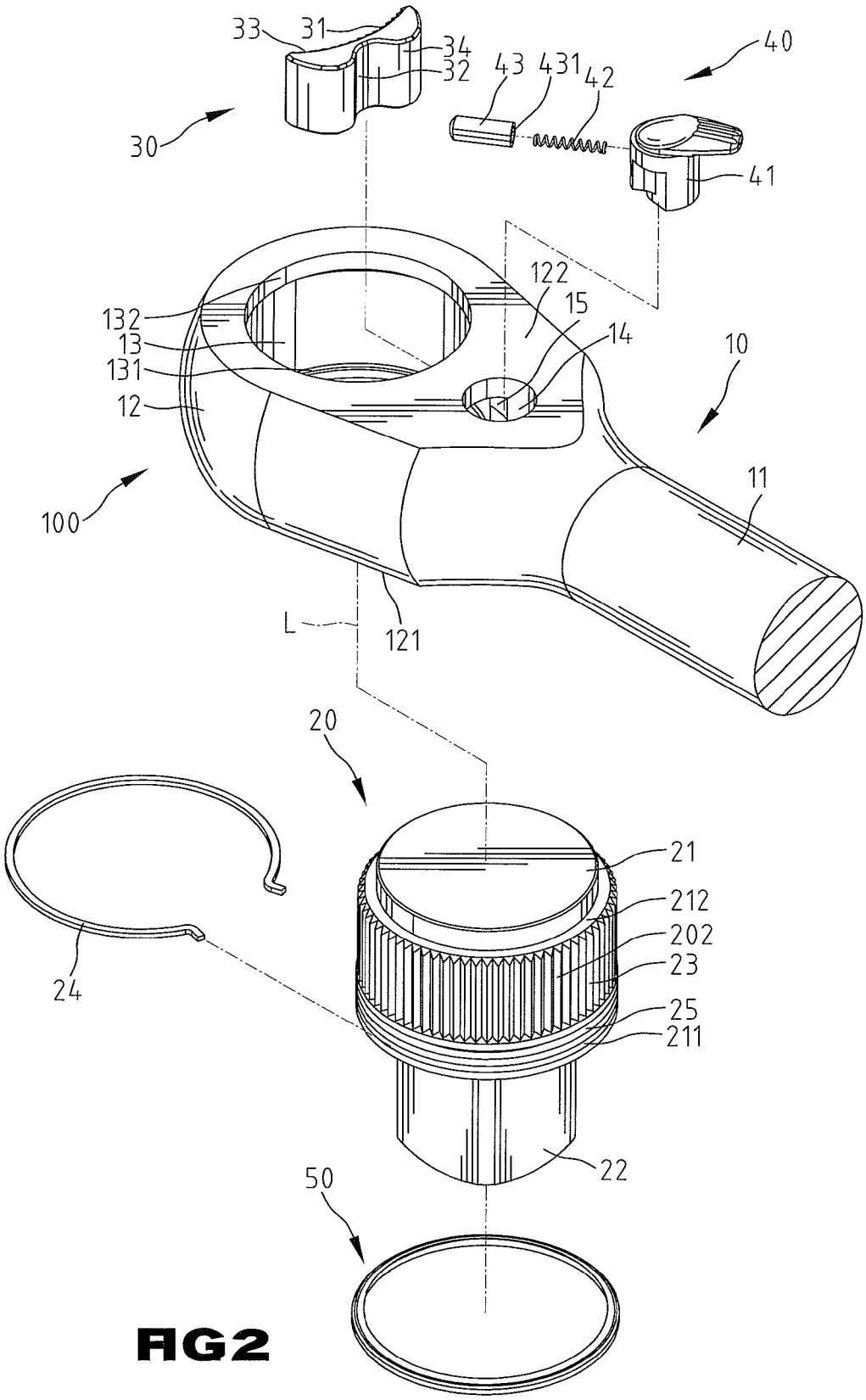
FIG. 2 shows an exploded, perspective view of the ratchet wrench of FIG. 1.
Figure 3:
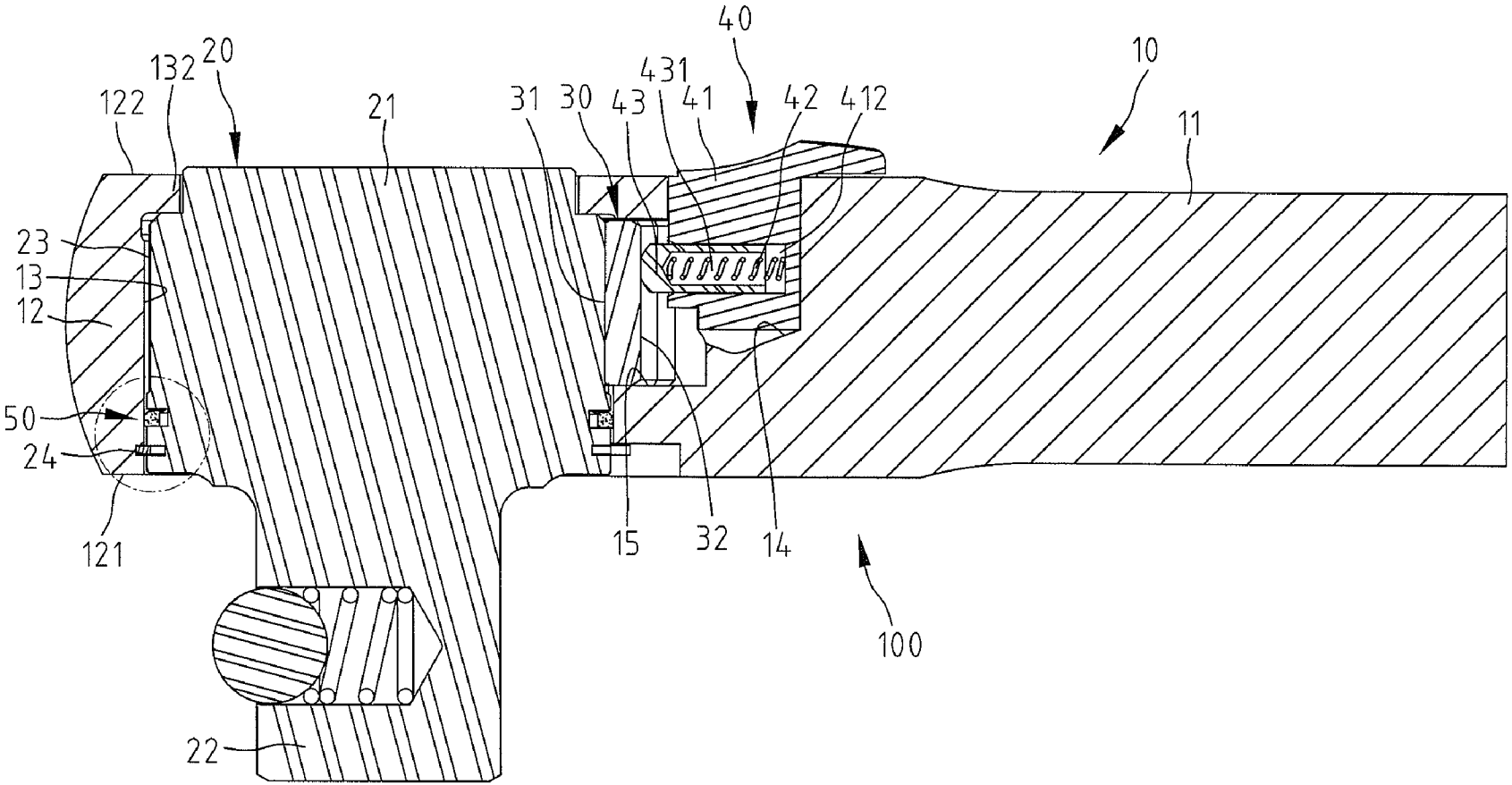
FIG. 3 shows a partial, cross sectional view of the ratchet wrench of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "axial", "radial", "annular", "spacing", "clockwise", "counterclockwise", "height", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings and generally designated 100. In preferred forms shown in FIGS. 1-16, ratchet wrench 100 includes a body 10 having a head 12 and a handle 11 interconnected to head 12. Head 12 includes first and second sides 121 and 122 spaced along an axis L. Head 12 further includes a compartment 13 extending from first side 121 through second side 122. A pawl groove 15 is defined in a peripheral wall of compartment 13. An annular flange 132 is formed on the peripheral wall of the compartment 13 at second side 122 of head 12. A switch groove 14 extends from second side 122 of head 12 toward but spaced from first side 121 of head 12 along axis L. Switch groove 14 is in communication with pawl groove 15. Pawl groove 15 is intermediate compartment 13 and switch groove 14 in a radial direction perpendicular to axis L. The peripheral wall of compartment 13 further includes an annular groove 131 adjacent first side 121 of head 12.

In the preferred forms shown in FIGS. 1-16, a drive member 20 is rotatably received in compartment 13 about axis L and includes an engaging portion 21, 21A and a driving portion 22, 22A adapted to directly or indirectly drive an object such as a fastener in the form of a bolt, nut; or the like. In the preferred forms shown in FIGS. 1-14, driving portion 22 is in the form of a drive column spaced from engaging portion 21 along axis L. The drive column can releasably engage with a socket or the like. Furthermore, engaging portion 21 of drive member 20 includes an annular shoulder 212 rotatably abutting annular flange 132 of head 12. In the preferred form shown in FIGS. 15-16, driving portion 22A of drive member 20 is in the form of a polygonal inner periphery radially inwards of engaging portion 21A. The polygonal inner periphery can engage and drive a fastener or the like. However, drive member 20 of other forms can be utilized according to the teachings of the present invention.

In the preferred forms shown in FIGS. 1-16, engaging portion 21, 21A of drive member 20 includes a plurality of teeth 23 formed on an outer periphery 202 thereof. Furthermore, a dust groove 25 is defined in outer periphery 202 of engaging portion 21, 21A. Dust groove 25 includes first and second faces 251 and 252 spaced along axis L. Second face 252 has a spacing to first side 121 of head 12 along the axis L larger than first face 251. Dust groove 25 further includes a third face 253 extending between first and second faces 251 and 252. First and second faces 251 and 252 are parallel to each other and extend perpendicularly to axis L. Third face 253 extends perpendicularly to first and second faces 251 and 252. First and second gaps G1 and G2 are defined between head 12 and engaging portion 21, 21A of drive member 20. Dust groove 25 is intermediate first and second gaps G1 and G2 along axis L. Second gap G2 is intermediate dust groove 25 and teeth 23 of drive member 20 along axis L. Dust groove 25 is in communication with teeth 23 of drive member 20 via second gap G2. An annular groove 211 is defined in outer periphery 202 of engaging portion 21, 21A. A retaining member 24 is received in annular grooves 211 and 131 of engaging portion 21, 21A and head 12, retaining engaging portion 21, 21A in compartment 13.

In the preferred forms shown in FIGS. 1-16, a pawl 30 is slideably received in pawl groove 15 and includes a first side 33 having a plurality of teeth 31 releasably engaged with teeth 23 of drive member 20. Pawl 30 further includes a second side 34 having a pressing portion 32 facing switch groove 14.

In the preferred forms shown in FIGS. 1-16, a control device 40 is mounted in switch groove 14 for controlling a driving direction of ratchet wrench 100. Specifically, control device 40 includes a switch 41 rotatably received in switch groove 14, a spring 42 received in a receptacle 412 in switch 41, and a pressing member 43 biased by spring 42 to press against pressing portion 32. An end of pressing member 43 is received in receptacle 412 of switch 41 and includes a receptacle 431 receiving spring 42. Teeth 31 of pawl 30 are biased by spring 42 to engage with teeth 23 of drive member 20. Switch 41 is rotatable between two positions, so that the other end of pressing member 43 selectively presses against one of two ends of pressing portion 32. Specifically, when pressing member 43 presses against one of the ends of pressing portion 32, head 12 and drive member 20 can rotate jointly in, e.g., a clockwise direction for driving the object, and head 12 can rotate freely in a counterclockwise direction relative to drive member 20 without driving the object. On the other hand, when pressing member 43 presses against the other end of pressing portion 32, head 12 and drive member 20 can rotate jointly in the counterclockwise direction for driving the object, and head 12 can rotate freely in the clockwise direction relative to drive member 20 without driving the object. Thus, the driving direction of ratchet wrench 100 can be changed by operating switch 41. Other forms of control device 40 for changing the driving direction of drive member 20 would be within the skill of the art.

In the preferred forms shown in FIGS. 1-16, ratchet wrench 100 further includes a dustproof seal 50, 50A compressed and received in dust groove 25. Seal 50, 50A is made of an elastic material and includes a ring 51, 51A, and a wing 52, 52A extending from ring 51, 51A. Ring 51, 51A includes a first surface 513, 513A and a second surface 514, 514A spaced from first surface 513, 513A along axis L. Ring 51, 51A further includes an outer periphery 511, 511A and an inner periphery 512, 512A spaced from outer periphery 511, 511A in the radial direction. Outer and inner peripheries 511 and 512, 511A and 512A extend between first and second surfaces 513 and 514, 513A and 514A. A diameter D511 of outer periphery 511, 511A of ring 51, 51A in a natural state in the radial direction is larger than a diameter D13 of the peripheral wall of compartment 13 in the radial direction, which, in turn, is larger than an outer diameter D21 of engaging portion 21 in the radial direction. An inclined face 515, 515A is formed between and at an obtuse angle to outer periphery 511, 511A and first surface 513, 513A of ring 51, 51A. Inner periphery 512, 512A of ring 51, 51A and wing 52, 52A are not in contact with third face 253 of dust groove 25.

In the preferred forms shown in FIGS. 1-11 and 15-16, wing 52 includes a first wing face 522 extending from and at an acute angle to first surface 513 of ring 51. Wing 52 further includes a second wing face 523 extending from and at an acute angle to inner periphery 512 of ring 51. First and second wing faces 522 and 523 meet at an edge 521. Inner periphery 512 of ring 51 is intermediate outer periphery 511 of ring 51 and edge 521 of wing 52 in the radial direction. Edge 521 is intermediate inner periphery 512 and third face 253 in the radial direction. A height H521 of wing 52 in a natural state measured from the second surface 514 along axis L is larger than a height H513 of ring 51 between first and second surfaces 513 and 514 along axis L and larger than a spacing between first and second faces 251 and 252 of dust groove 25 along axis L. Thus, a chamber 53 is defined between inner periphery 512, second wing face 523, first face 251, and third face 253.

Figure 12:
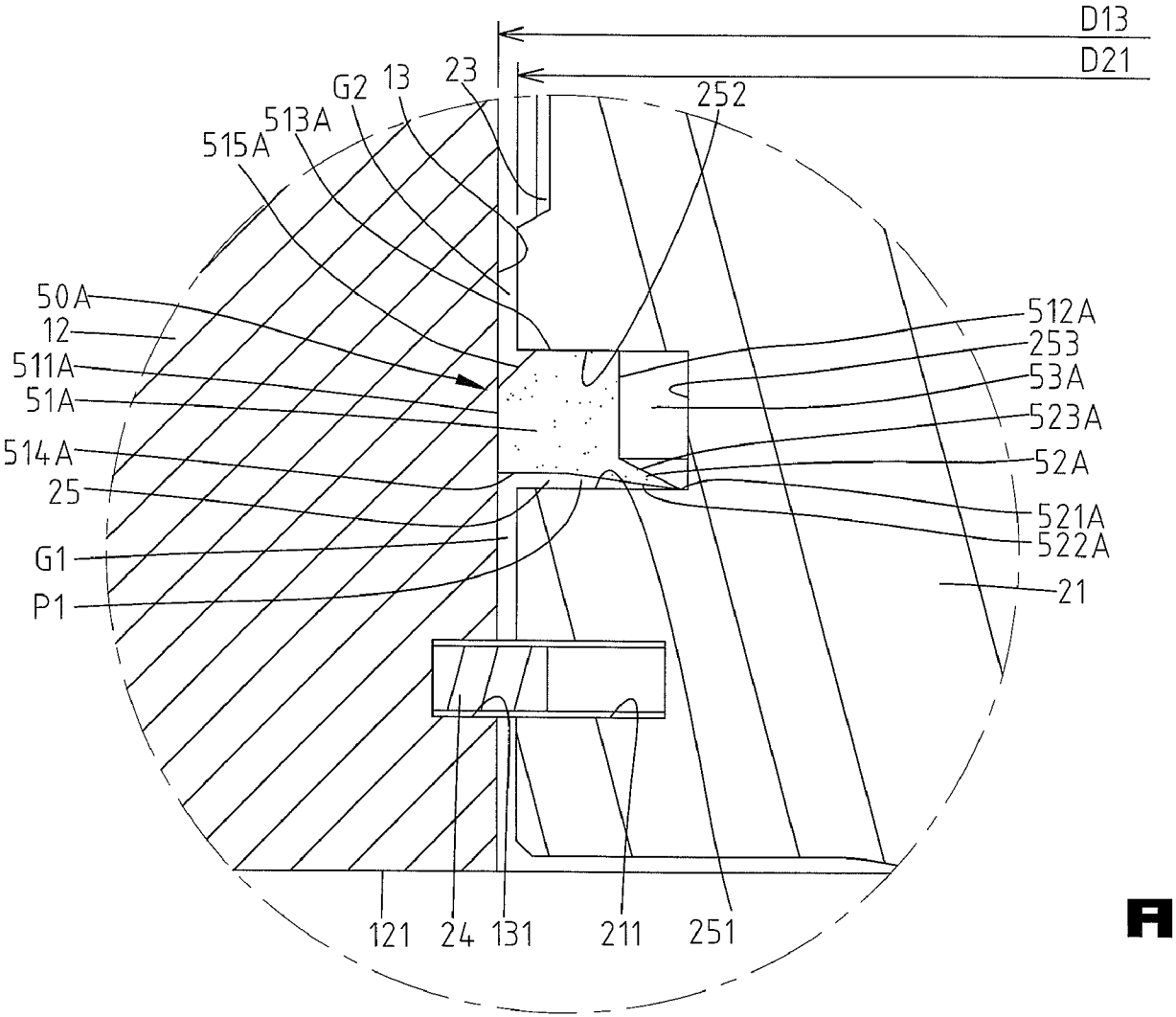
FIG. 12 shows a partial, cross sectional view of a ratchet wrench of a second embodiment according to the preferred teachings of the present invention.
Figure 13:
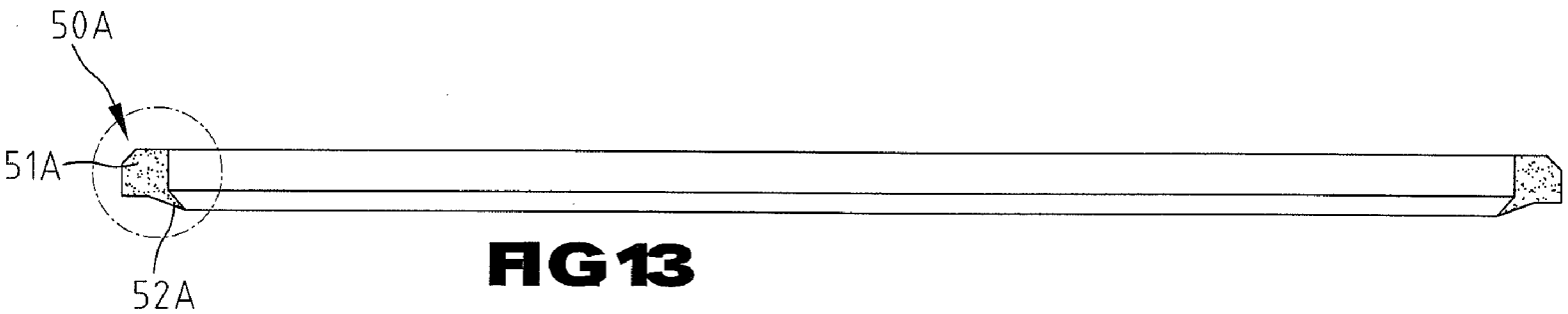
FIG. 13 shows a partial, perspective view of a dustproof seal of FIG. 12 with portions of the dustproof seal broken away and with the dustproof seal in a natural, uncompressed state.
Figure 14:
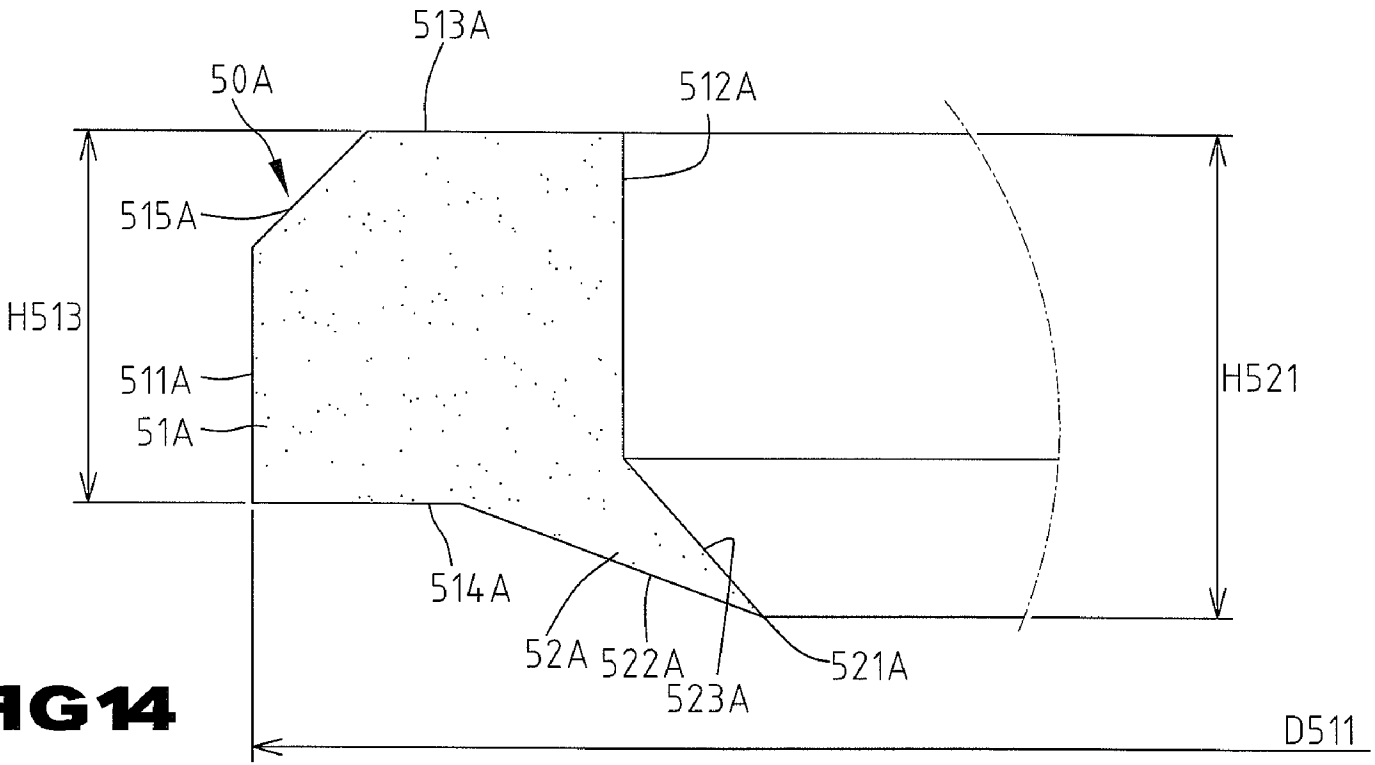
FIG. 14 shows an enlarged view of a circled portion of FIG. 13.
Figure 15:
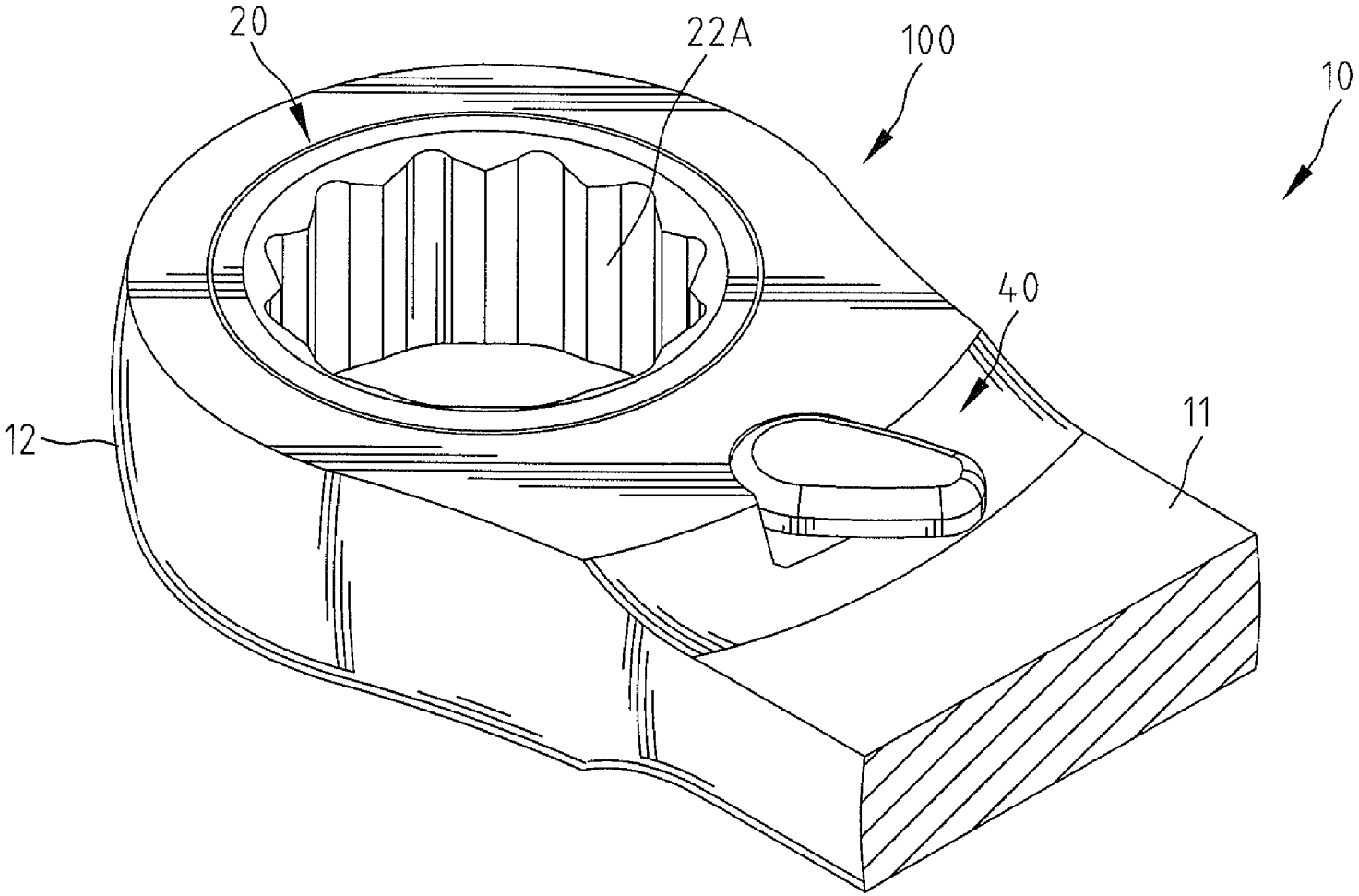
FIG. 15 shows a perspective view of a ratchet wrench of a third embodiment according to the preferred teachings of the present invention.
Figure 16:
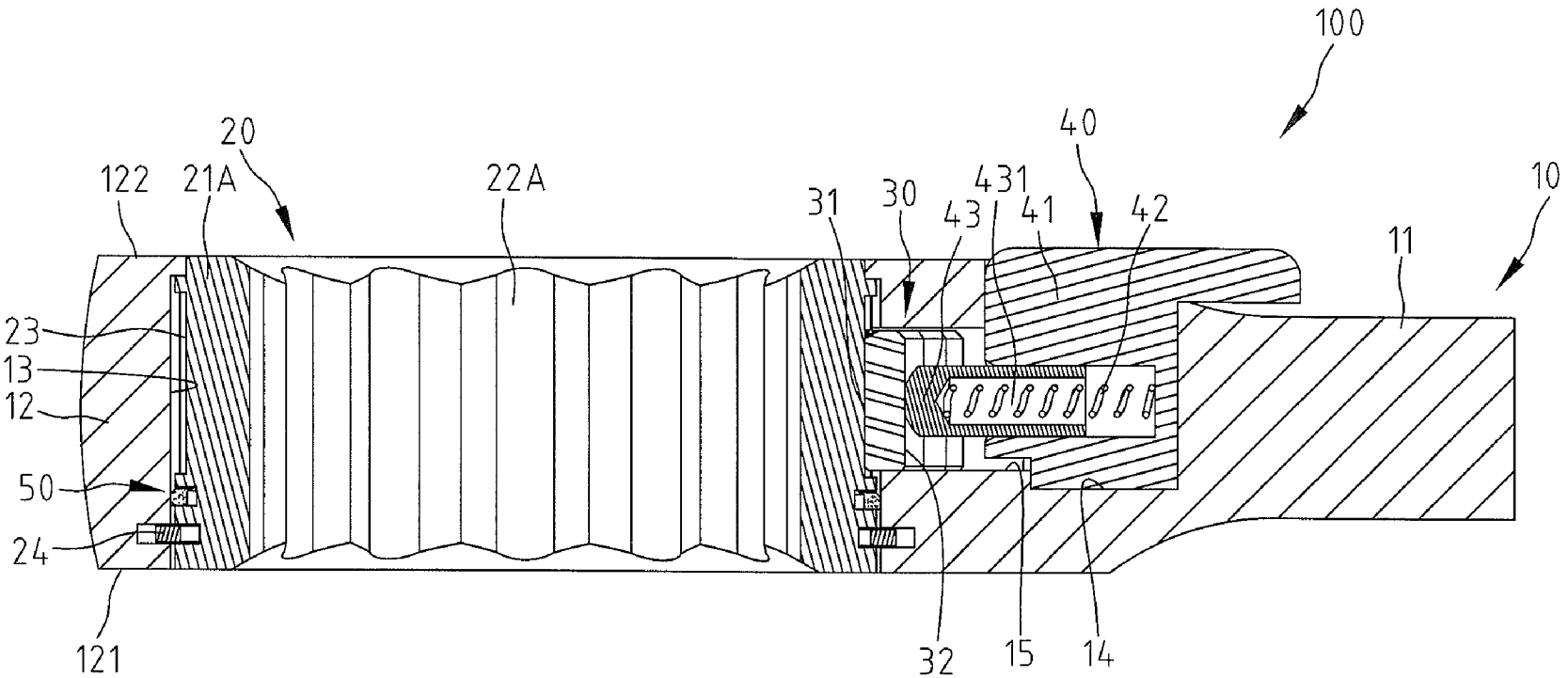
FIG. 16 shows a cross sectional view of the ratchet wrench of FIG. 15.

In the preferred form shown in FIGS. 12-14, wing 52A includes a first wing face 522A extending from and at an acute angle to second surface 514A of ring 51A. Wing 52A further includes a second wing face 523A extending from and at an acute angle to inner periphery 512A of ring 51A. First and second wing faces 522A and 523A meet at an edge 521A. Inner periphery 512A of ring 51A is intermediate outer periphery 511A of ring 51A and edge 521A of wing 52A in the radial direction. Edge 521A is intermediate inner periphery 512A and third face 253 in the radial direction. Height H521 of wing 52A in a natural state measured from the first surface 513A of ring 51A along axis L is larger than height H513 between first and second surfaces 513A and 514A along axis L and larger than the spacing between first and second faces 251 and 252 of dust groove 25 along axis L. Thus, a chamber 53A is defined between inner periphery 512A, second wing face 523A, second face 252, and third face 253.

In the preferred forms shown in FIGS. 1-16, dustproof seal 50, 50A is compressed and received in dust groove 25. Outer periphery 511, 511A of ring 51, 51A presses against the peripheral wall of compartment 13. Edge 521, 521A is located between inner periphery 512, 512A of ring 51, 51A and third face 253 of dust groove 25 in the radial direction. In the preferred forms shown in FIGS. 1-11 and 15-16, wing 52 presses against second face 252 of dust groove 25, and second surface 514 of ring 51 presses against second face 252 of dust groove 25, blocking communication between first and second gaps G1 and G2. Inclined face 515 is intermediate and spaced from first and second faces 251 and 252 of dust groove 25 along axis L. A space P2 is defined between second face 252, first surface 513, and first wing face 522. In the preferred form shown in FIGS. 12-14, wing 52A presses against first face 251 of dust groove 25, and first surface 513A of ring 51A presses against second face 252 of dust groove 25, blocking communication between first and second gaps G1 and G2. A space P1 is defined between first face 251, second surface 514A, and first wing face 522A.

Figure 4:
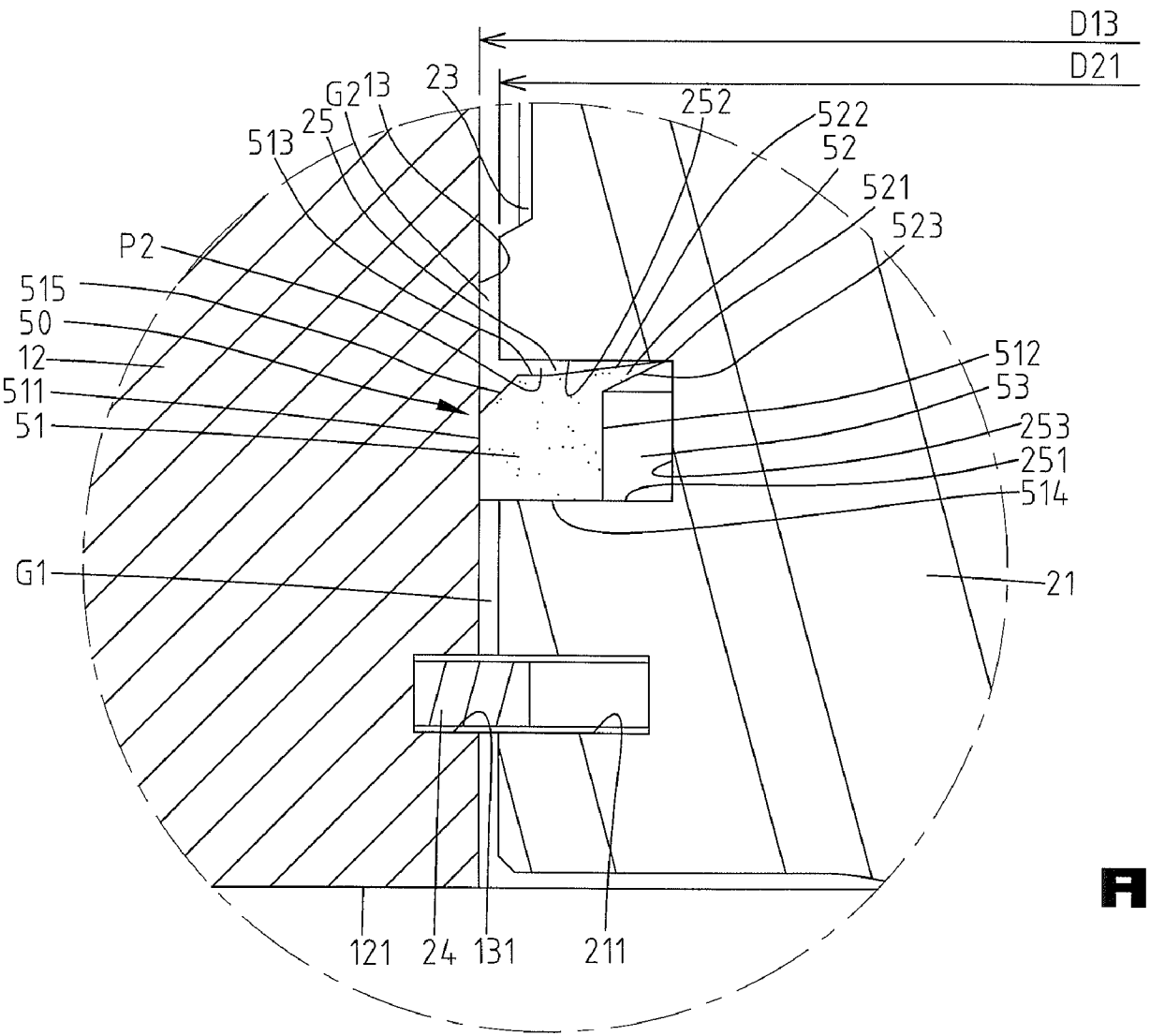
FIG. 4 shows an enlarged view of a circled portion of FIG. 3.
Figure 5:
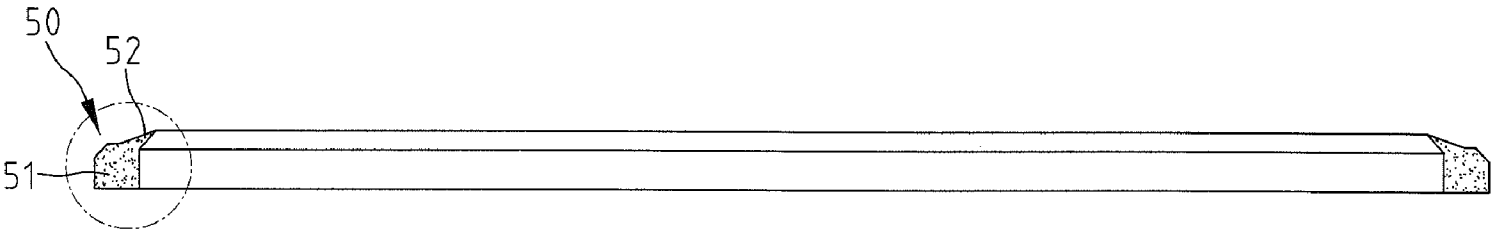
FIG. 5 shows a partial, perspective view of a dustproof seal of FIG. 4 with portions of the dustproof seal broken away and with the dustproof seal in a natural, uncompressed state.
Figure 6:
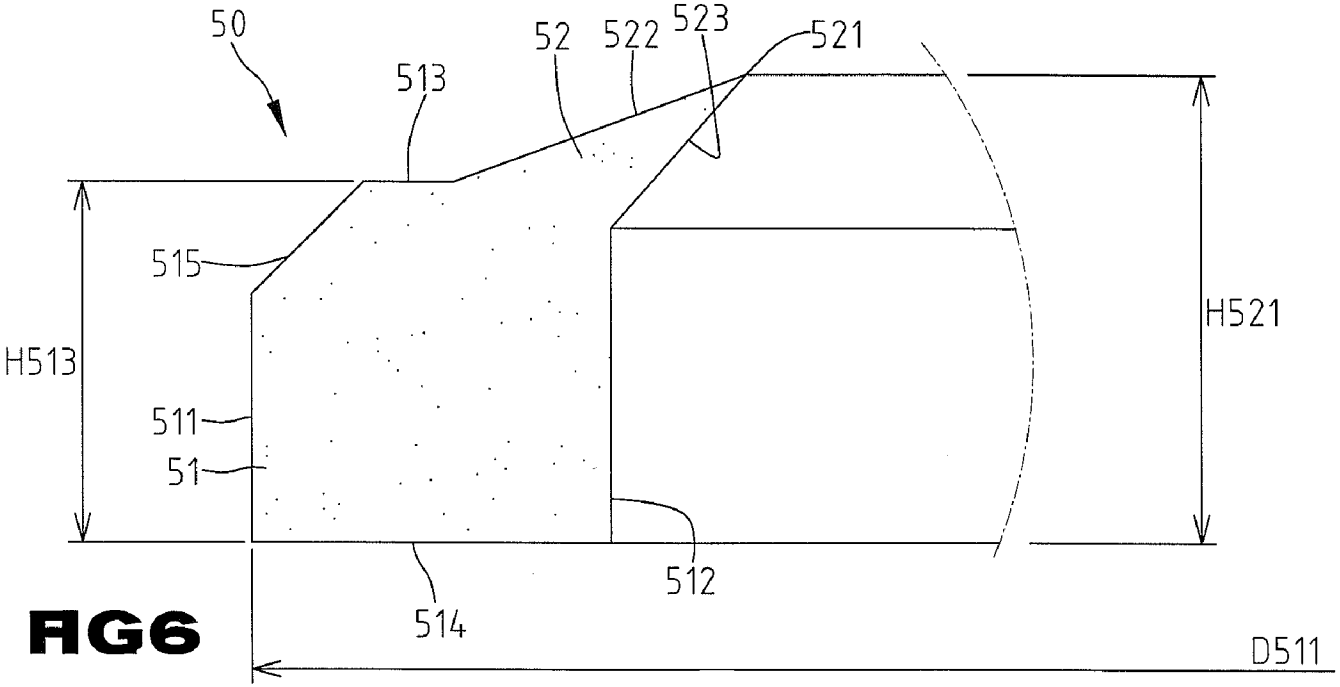
FIG. 6 shows an enlarged view of a circled portion of FIG. 5.
Figure 7:
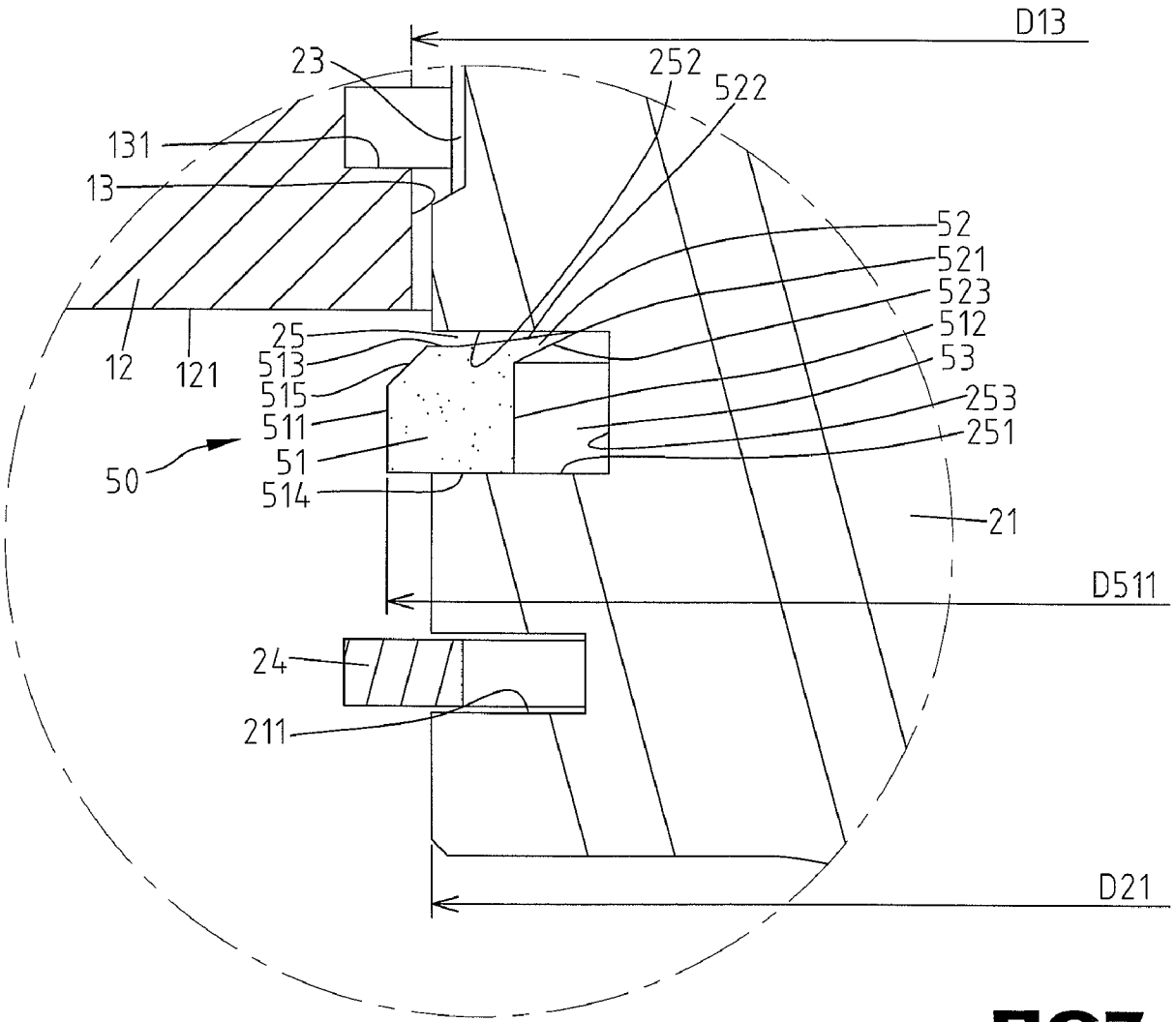
FIG. 7 shows a partial, cross sectional view similar to FIG. 4, illustrating mounting of a drive member into a head of the ratchet wrench, with the dustproof seal in the natural, uncompressed state.
Figure 8:
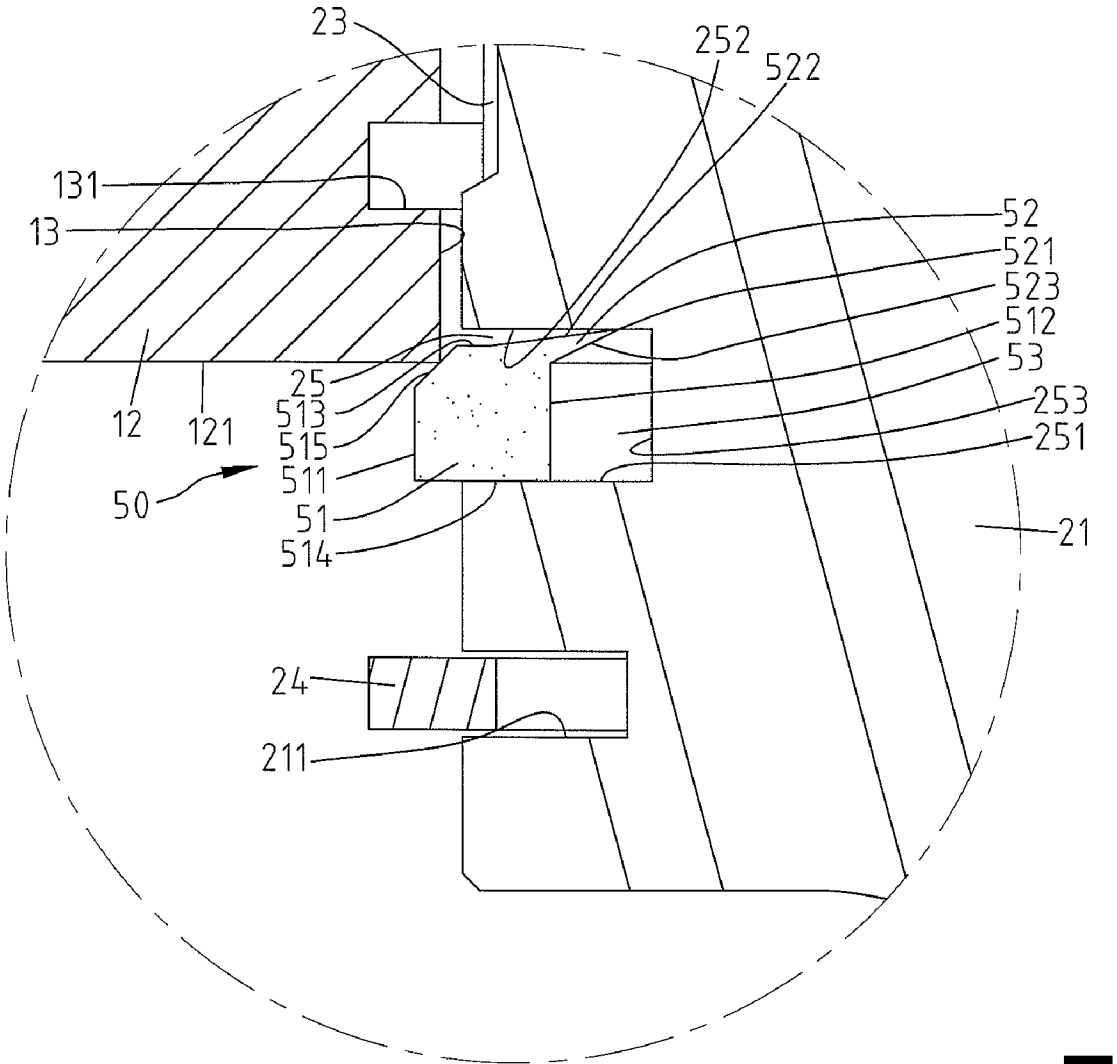
FIG. 8 shows a partial, cross sectional view similar to FIG. 7, with the dustproof seal moved toward and in contact with a side of the head.
Figure 9:
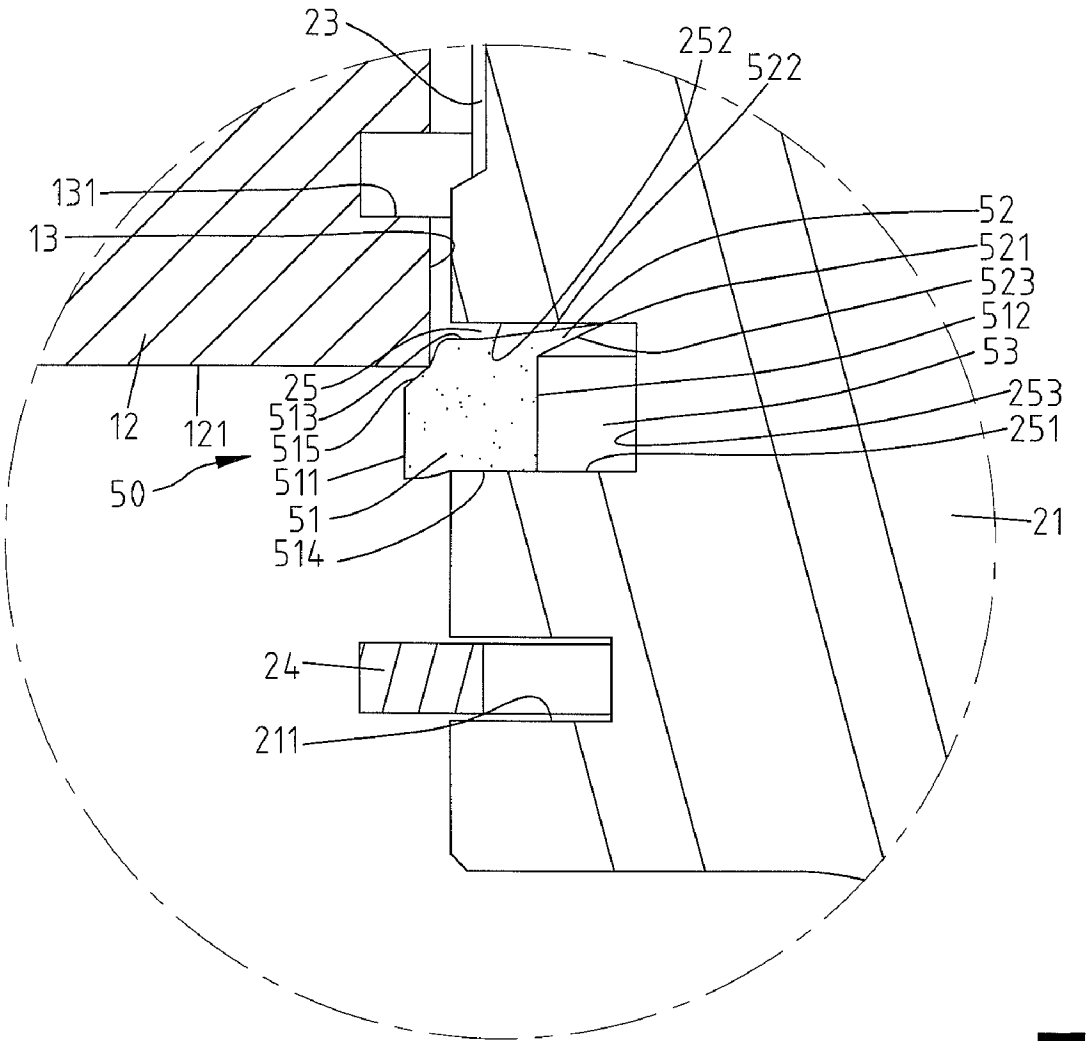
FIG. 9 shows a partial, cross sectional view similar to FIG. 8, with the dustproof seal moved further toward the head and partially compressed.
Figure 10:
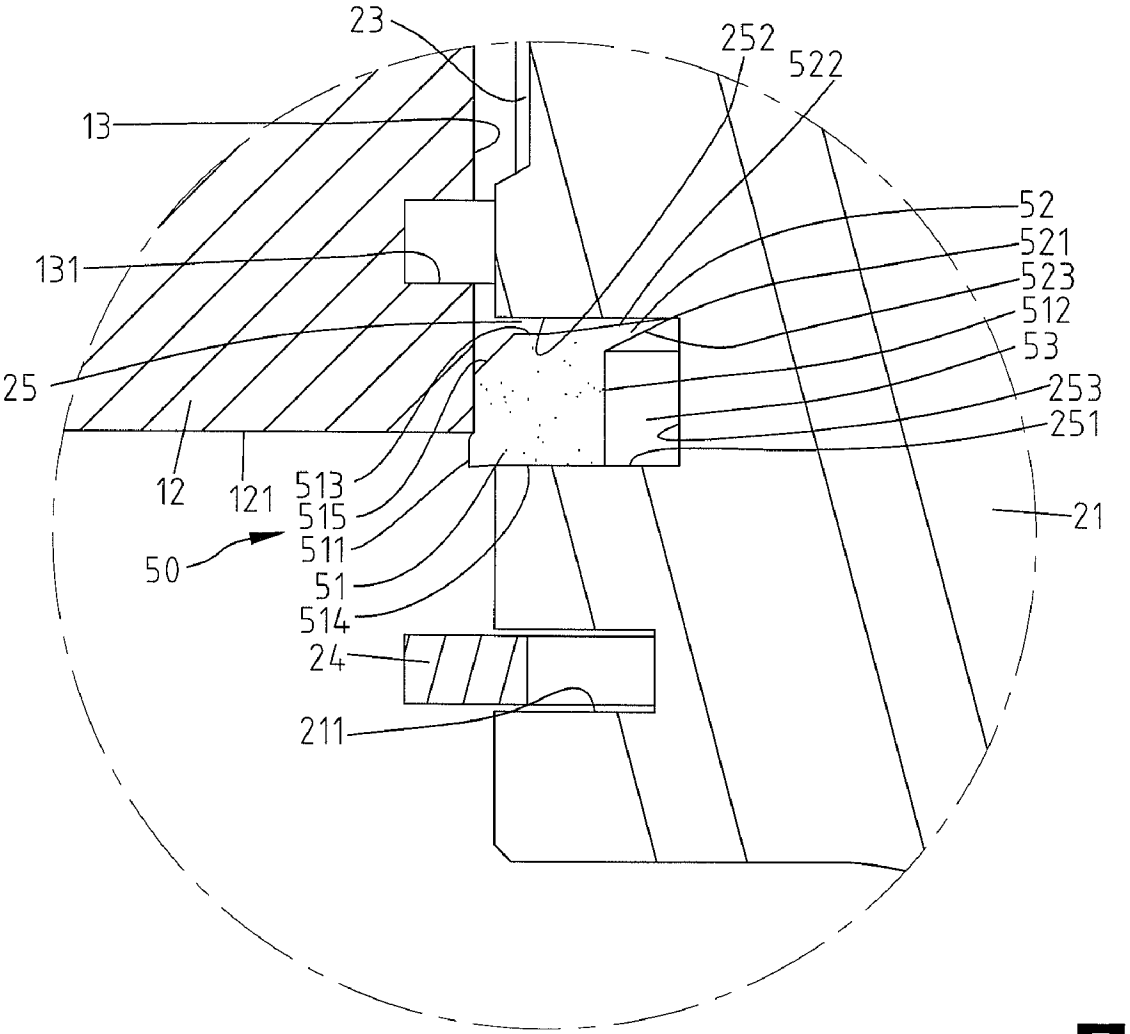
FIG. 10 shows a partial, cross sectional view similar to FIG. 9, with the dustproof seal moved further toward the head and further compressed.

FIGS. 7-10 show assembly of drive member 20 and head 12 of ratchet wrench 100 according to the teachings of the present invention. Seal 50 is firstly mounted into and, thus, partially received in dust groove 25, because diameter D511 of seal 50 is larger than outer diameter D21 of pivotal portion 21 of head 20. Namely, an outer portion of ring 51 including inclined face 515 is exposed outside of dust groove 25. Second surface 514 of ring 51 presses against first face 251 of dust groove 25 (FIG. 7). Drive member 20 is moved toward compartment 13 of head 12. Ring 51 comes in contact with an edge of first side 121 of head 12. Seal 50 deforms while the exposed portion of seal 50 is passing through and pressing against the edge of first side 121 of head 12. Chamber 53 allows deformation of seal 50 in the radial direction, and inclined face 515 allows easy insertion of seal 50 into compartment 13 of head 12 (FIGS. 8 and 9). After inclined face 515 has passed through the edge of first side 121 of head 12, outer periphery 511 of ring 51 comes in contact with and presses against the peripheral wall of compartment 13 of head 12 by further moving drive member 20 into compartment 13 (FIG. 10). Drive member 20 is moved further into compartment 13 until drive member 20 is completely received in compartment 13 (FIG. 4). Retaining member 24 is positioned in annular groove 131 of head 12. Outer periphery 511 of ring 51 tightly presses against the peripheral wall of compartment 13 of head 12. Furthermore, wing 52 presses against second face 252 of dust groove 25. Assembly of ratchet wrench 100 shown in FIGS. 12-14 can be accomplished in a manner substantially shown in FIGS. 7-10.

The functions of seal 50 according to the teachings of the present invention will now be set forth with reference to FIG. 4. In a case that dust, debris, or the like enters first gap G1 via first side 121 of head 12, the dust can not enter second gap G2, because outer periphery 511 of ring 51 tightly presses against the peripheral wall of compartment 13. Furthermore, the dust can not enter chamber 53, because second surface 514 of ring 51 presses against first face 251 of dust groove 25. First face 251 of dust groove 25 perpendicular to axis L also increases difficulties to movement of the dust from first gap G1 into chamber 53. Thus, the dust will remain in first gap G1. Even if the dust enters chamber 53, the dust will remain in chamber 53, because wing 52 presses against second face 252 of dust groove and, thus, blocks passage between chamber 53 and space P2. Second face 252 of dust groove 25 perpendicular to axis L also increases difficulties to movement of the dust from chamber 53 to space P2. It can be appreciated that smooth pivotal movement of head 12 relative to drive member 20 will not be adversely affected, because wing 52 of seal 50 merely presses against second face 252 of dust groove 25.

The functions of seal 50A according to the teachings of the present invention will now be set forth with reference to FIG. 12. In a case that dust, debris, or the like enters first gap G1 via first side 121 of head 12, the dust can not enter second gap G2, because outer periphery 511A of ring 51A tightly presses against the peripheral wall of compartment 13. Furthermore, the dust can not enter chamber 53A via space P1, because wing 52A presses against first face 251 of dust groove 25. First face 251 of dust groove 25 perpendicular to axis L also increases difficulties to movement of the dust from first gap G1 into chamber 53A. Thus, the dust will remain in first gap G1 and space P1. Even if the dust enters chamber 53A, the dust will remain in chamber 53A, because first surface 513A of ring 51A presses against second face 252 of dust groove 25 and, thus, blocks passage between chamber 53A and second gap G2. Second face 252 of dust groove 25 perpendicular to axis L also increases difficulties to movement of the dust from chamber 53A to second gap G2. It can be appreciated that smooth pivotal movement of head 12 relative to drive member 20 will not be adversely affected, because wing 52A of seal 50A merely presses against first face 251 of dust groove 25.

Figure 11:
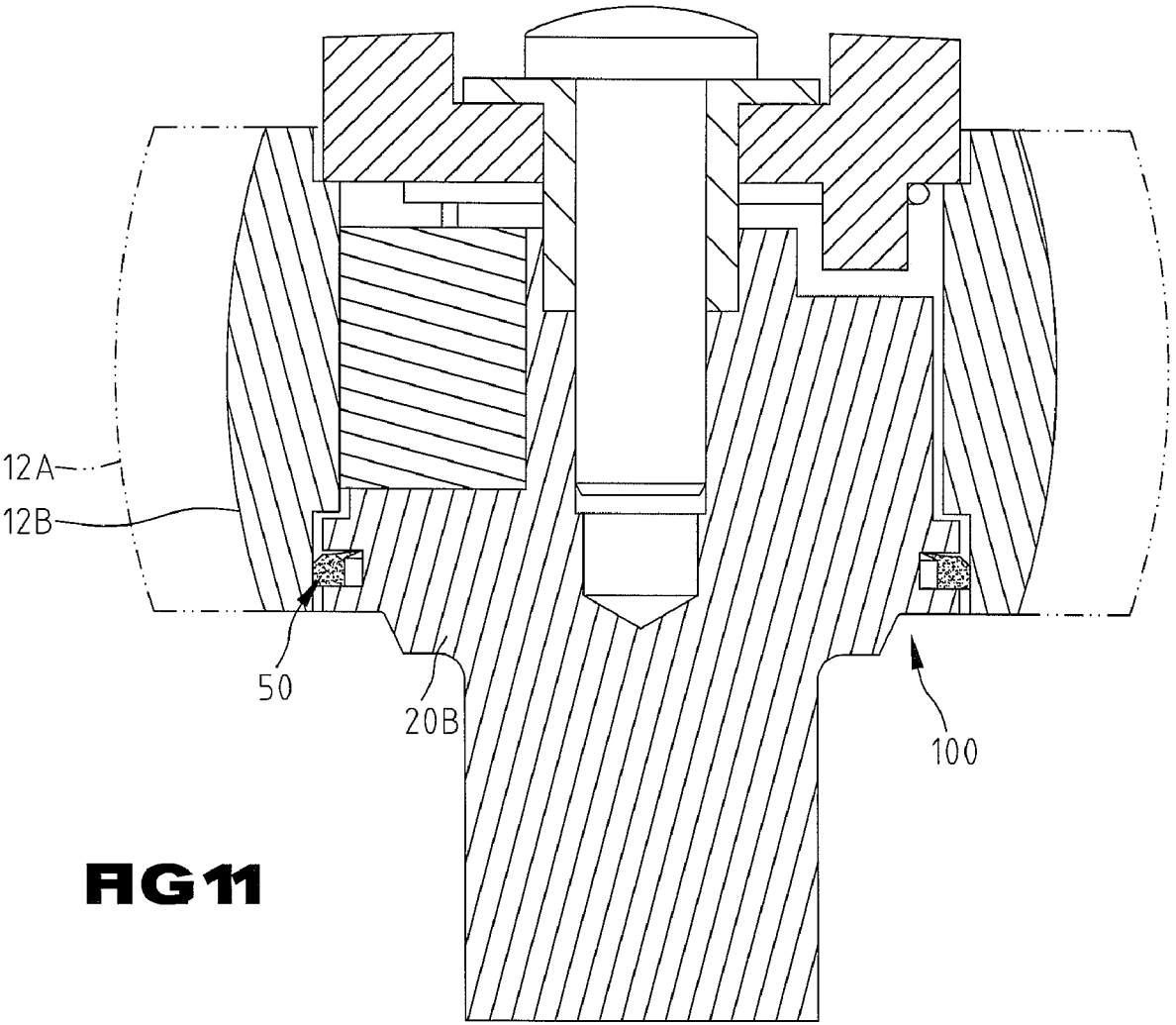
FIG. 11 shows a cross sectional view of the ratchet wrench according to the preferred teachings of the present invention.

Furthermore, since dust groove 25 is formed in drive member 20, the overall thickness and the overall diameter 12B of head 12 will not be increased. FIG. 11 shows a comparison of the size of ratchet wrench 100 (shown by solid lines) according to the teachings of the present invention and a conventional ratchet wrench (shown by phantom lines) having a drive column of the same size as that of ratchet wrench 100. The overall diameter 12B of ratchet wrench 100 according to the teachings of the present invention is much smaller than the outer diameter 12A of the conventional ratchet wrench. The overall weight of ratchet wrench 100 according to the teachings of the present invention is, thus, effectively reduced.

Now that the basic teachings of the present invention have been explained, many extensions and variations will be obvious to one having ordinary skill in the art. For example, seal 50, 50A does not have to include inclined face 515, 515A without adversely affecting the sealing functions. Furthermore, teeth 23 of drive member 20 can extend to second face 252 of dust groove 25, such that second gap G2 is intermediate teeth 23 and the peripheral wall of compartment 13 in the radial direction.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a head including first and second sides spaced along an axis, with the head further including a compartment having a peripheral wall and extending from the first side through the second side of the head, with the head further including a pawl groove defined in the peripheral wall of the compartment;

a handle interconnected to the head;

a drive member including an engaging portion rotatably received in the compartment about the axis, with the drive member further including a driving portion adapted to drive an object, with the engaging portion of the drive member including an outer periphery having a plurality of teeth, with the outer periphery of the engaging portion of the drive member further including a dust groove, with the dust groove including first and second faces spaced along the axis, with the second face having a spacing to the first side of the head along the axis larger than the first face, with the dust groove further including a third face extending between the first and second faces, with first and second gaps defined between the head and the engaging portion of the drive member, with the dust groove intermediate the first and second gaps along the axis and in communication with the plurality of teeth of the drive member via the second gap;

a pawl slideably received in the pawl groove and including a plurality of teeth for engagement with the plurality of teeth of the drive member; and a dustproof seal made of an elastic material and including a ring and a wing extending from the ring, with the ring including first and second surfaces spaced along the axis, the ring further including outer and inner peripheries spaced in a radial direction perpendicular to the axis and extending between the first and second surfaces, with a diameter of the outer periphery of the ring in a natural state in the radial direction being larger than a diameter of the peripheral wall of the compartment in the radial direction, with the wing extending from one of the first and second surfaces of the ring, with a height of the wing in a natural state measured from the other of the first and second surfaces of the ring along the axis being larger than a height of the ring between the first and second surfaces of the ring and larger than a spacing between the first and second faces of the dust groove along the axis, with the dustproof seal compressed and received in the dust groove, with the outer periphery of the ring pressing against the peripheral wall of the compartment, with the wing pressing against one of the first and second faces of the dust groove, with the other of the first and second surfaces of the ring pressing against the other one of the first and second faces of the dust groove, with the inner periphery of the ring and the wing not in contact with the third face of the dust groove, with communication between the first and second gaps being blocked by the seal.

2. The ratchet wrench as claimed in claim 1, with the dustproof seal further including an inclined face formed between and at an obtuse angle to the outer periphery and the first surfaces of the ring.

3. The ratchet wrench as claimed in claim 2, with the inclined face intermediate and spaced from the first and second faces of the dust groove along the axis.

4. The ratchet wrench as claimed in claim 3, with the wing including a first wing face extending from and at a first acute angle to the first surface of the ring, with the wing further including a second wing face extending from and at a second acute angle to the inner periphery of the ring, with the first and second wing faces meeting at an edge, with the inner periphery of the ring intermediate the outer periphery of the ring and the edge of the wing in the radial direction, with the edge of the wing intermediate the inner periphery of the ring and the third face of the dust groove in the radial direction, and with the edge pressing against the second face of the dust groove.

5. The ratchet wrench as claimed in claim 4, with the first and second faces of the dust groove parallel to each other and extending perpendicularly to the axis.

6. The ratchet wrench as claimed in claim 5, with the third face of the dust groove extending perpendicularly to the first and second faces of the dust groove.

7. The ratchet wrench as claimed in claim 2, with the wing including a first wing face extending from and at a first acute angle to the second surface of the ring, with the wing further including a second wing face extending from and at a second acute angle to the inner periphery of the ring, with the first and second wing faces meeting at an edge, with the inner periphery of the ring intermediate the outer periphery of the ring and the edge of the wing in the radial direction, with the edge of the wing intermediate the inner periphery of the ring and the third face of the dust groove in the radial direction, and with the edge pressing against the first surface of the dust groove.

8. The ratchet wrench as claimed in claim 7, with the first and second faces of the dust groove parallel to each other and extending perpendicularly to the axis.

9. The ratchet wrench as claimed in claim 8, with the third face of the dust groove extending perpendicularly to the first and second faces of the dust groove.

10. The ratchet wrench as claimed in claim 1, with the wing including a first wing face extending from and at a first acute angle to the first surface of the ring, with the wing further including a second wing face extending from and at a second acute angle to the inner periphery of the ring, with the first and second wing faces meeting at an edge, with the inner periphery of the ring intermediate the outer periphery of the ring and the edge of the wing in the radial direction, with the edge of the wing intermediate the inner periphery of the ring and the third face of the dust groove in the radial direction, and with the edge pressing against the second face of the dust groove.

11. The ratchet wrench as claimed in claim 10, with the first and second faces of the dust groove parallel to each other and extending perpendicularly to the axis, and with the third face of the dust groove extending perpendicularly to the first and second faces of the dust groove.

12. The ratchet wrench as claimed in claim 11, with the head further including an annular flange formed on the peripheral wall of the compartment at the second side of the head, and with the drive member further including an annular shoulder rotatably pressing against the annular flange.

13. The ratchet wrench as claimed in claim 11, further comprising, in combination: a retaining member, with the head further including an annular groove defined in the peripheral wall of the compartment and intermediate the first side and the dust groove along the axis, with the drive member further including an annular groove defined in the outer periphery of the engaging portion, and with the retaining member received in the annular grooves of the engaging portion and the head, retaining the engaging portion of the drive member in the compartment.

14. The ratchet wrench as claimed in claim 11, further comprising, in combination: a control device, with the head further including a switch groove extending from the second side of the head towards but spaced from the first side of the head, with the switch groove in communication with the pawl groove, with the control device received in the switch groove, with the control device engaged with the pawl and manually operable to move the pawl between two positions corresponding to two opposite driving directions of the ratchet wrench.

15. The ratchet wrench as claimed in claim 14, with the control device including:

a switch rotatably received in the switch groove and including a first receptacle;

a pressing member including first and second ends and a second receptacle formed in the first end of the pressing member; and a spring received in the first and second receptacles, with the spring biasing the second end of the pressing member to press against the pawl, with the switch pivotable to move the pressing member for sliding the pawl between the two positions.

16. The ratchet wrench as claimed in claim 1, with the wing including a first wing face extending from and at a first acute angle to the second surface of the ring, with the wing further including a second wing face extending from and at a second acute angle to the inner periphery of the ring, with the first and second wing faces meeting at an edge, with the outer periphery of the ring intermediate the outer periphery of the ring and the edge of the wing in the radial direction, with the edge of the wing intermediate the inner periphery of the ring and the third face of the dust groove in the radial direction, and with the edge pressing against the first face of the dust groove.

17. The ratchet wrench as claimed in claim 16, with the first and second faces of the dust groove parallel to each other and extending perpendicularly to the axis, and with the third face of the dust groove extending perpendicularly to the first and second faces of the dust groove.

* * * * *